United States Patent [19]

Farnsworth

[11] Patent Number: 4,786,400

[45] Date of Patent: Nov. 22, 1988

[54] METHOD AND APPARATUS FOR CATALYTICALLY CONVERTING FRACTIONS OF CRUDE OIL BOILING ABOVE GASOLINE

[76] Inventor: Carl D. Farnsworth, 2401 Sedley Rd., Charlotte, N.C. 28211

[21] Appl. No.: 648,676

[22] Filed: Sep. 10, 1984

[51] Int. Cl.[4] ..... C10G 51/06; C10G 55/08

[52] U.S. Cl. ..... 208/80; 208/86; 208/89; 208/92; 208/155; 208/164; 502/43

[58] Field of Search ..... 208/86, 92, 93, 78, 208/80, 89, 211, 212, 95, 155, 164; 502/43

[56] References Cited

U.S. PATENT DOCUMENTS

| | | | |
|---|---|---|---|
| 2,684,931 | 7/1954 | Berg | 196/52 |
| 2,702,267 | 2/1955 | Keith | 196/52 |
| 2,906,703 | 9/1959 | Dalla Valle | 208/149 |
| 2,930,748 | 3/1960 | Montgomery et al. | 208/211 |
| 3,188,185 | 6/1965 | Slynagstad et al. | 23/288 |
| 3,287,254 | 11/1966 | Paterson | 208/68 |
| 3,379,639 | 4/1968 | Vallino, Jr. | 208/80 |
| 3,406,112 | 10/1968 | Bowles | 208/153 |
| 3,785,962 | 1/1974 | Conner et al. | 208/164 |
| 3,856,659 | 12/1974 | Owen | 208/164 |
| 3,886,060 | 5/1975 | Owen | 208/120 |
| 3,894,933 | 7/1975 | Owen et al. | 208/95 |
| 3,898,050 | 8/1975 | Strothers | 23/288 |
| 3,926,843 | 12/1975 | Owen | 208/164 |
| 3,928,175 | 12/1975 | Owen et al. | 208/93 |
| 3,951,781 | 4/1976 | Owen et al. | 208/86 |
| 3,968,023 | 7/1976 | Yan | 208/93 |
| 4,010,003 | 3/1977 | Pulak | 23/288 |
| 4,035,284 | 7/1977 | Gross et al. | 208/120 |
| 4,062,759 | 12/1977 | Castagnos, Jr. et al. | 208/164 |
| 4,116,814 | 9/1978 | Zahner | 208/164 |
| 4,165,274 | 8/1979 | Kwant | 208/93 |
| 4,219,407 | 8/1980 | Haddad | 208/151 |
| 4,310,489 | 1/1982 | Fahrig et al. | 422/110 |
| 4,313,910 | 2/1982 | Dries et al. | 422/147 |
| 4,387,043 | 6/1983 | Vickers et al. | 252/417 |
| 4,422,925 | 12/1983 | Williams et al. | 208/164 |

*Primary Examiner*—Andrew H. Metz
*Assistant Examiner*—Anthony McFarlane
*Attorney, Agent, or Firm*—Richard C. Willson, Jr.

[57] ABSTRACT

A dual riser cracking operation in combination with sequential stages of catalyst regeneration in which the second regeneration stage is a riser regenerator is described in combination with deep solvent deasphalting a vacuum resid. The deasphalted resid is subjected to hydrogenation treatment prior to cracking thereof in a riser cracking zone in admixture with a heavy vacuum gas oil which may or may not be hydrogenated prior to cracking thereof. Lower boiling fractions of the crude oil are subjected to catalytic cracking in a separate riser cracking zone. Partially regenerated catalyst of dense fluid bed regeneration may be employed in the heavy oil feed riser cracking operation charged with deasphalted oil. The partially regenerated catalyst may be used alone or in combination with more completely regenerated catalyst of the riser regeneration operation.

17 Claims, 2 Drawing Sheets

FIG. I
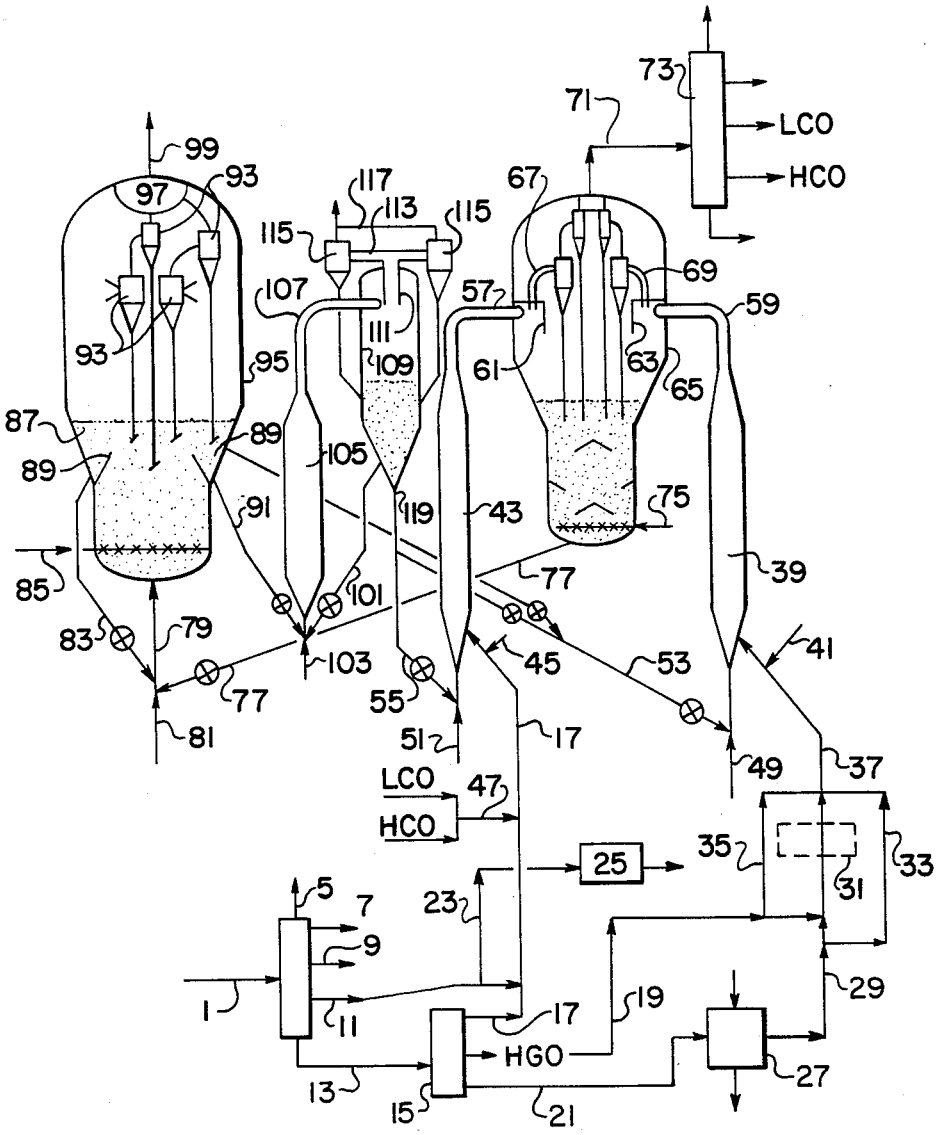

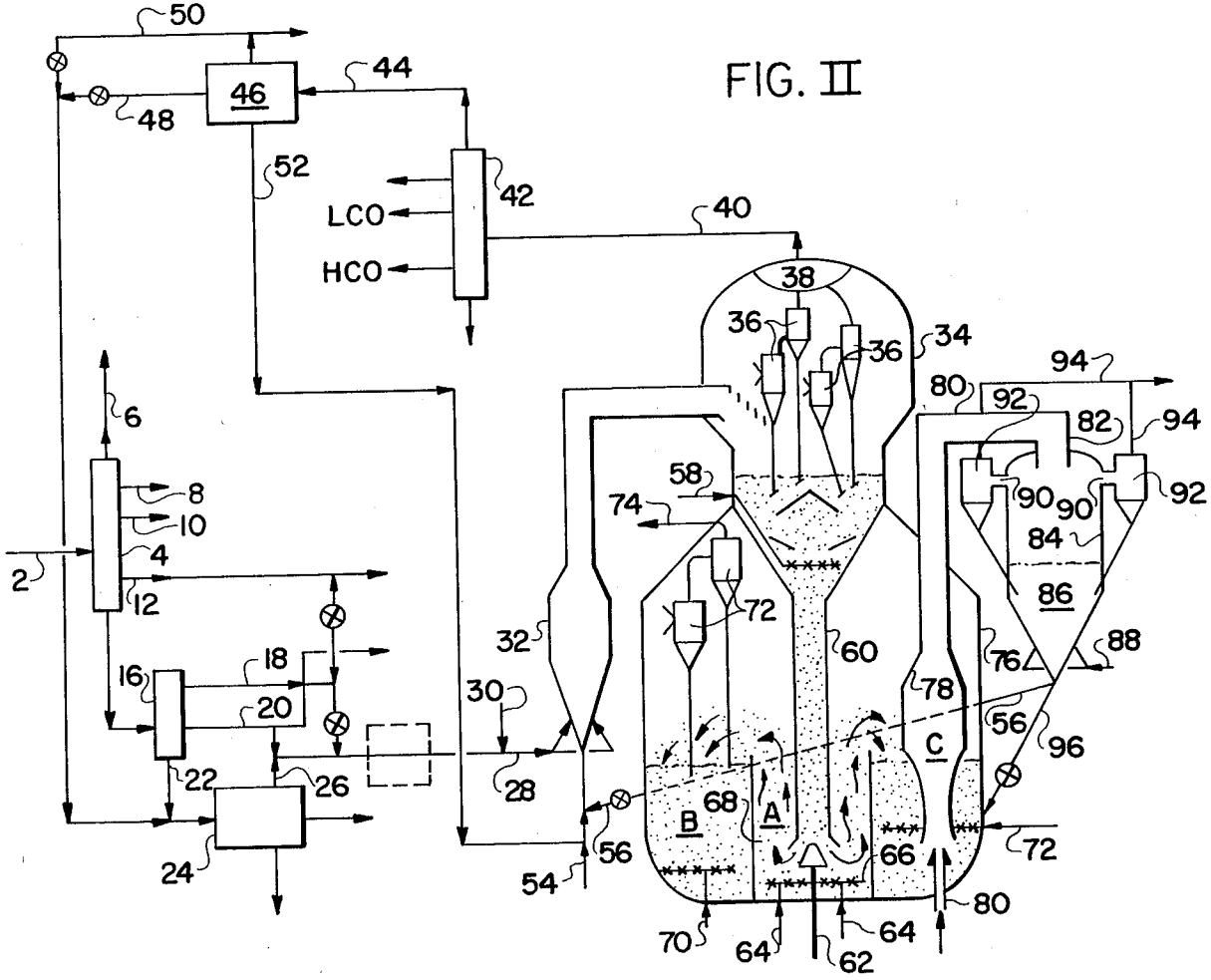
FIG. II

METHOD AND APPARATUS FOR CATALYTICALLY CONVERTING FRACTIONS OF CRUDE OIL BOILING ABOVE GASOLINE

BACKGROUND OF THE INVENTION

The development of fluid catalyst cracking FCC systems has been an on-going challenge since the early '40's. This challenge has been stimulated considerably by the development of improved catalysts and particularly the crystalline zeolite (alumino-silicate) containing catalyst of acceptable cracking activity.

Berg U.S. Pat. No. 2,684,931 identifies early fluidized solids catalytic cracking and regeneration of catalyst solids in dense fluid bed operations. The catalyst solids are conveyed upwardly in riser conduits with lift gas which discharge into the bottom of the dense fluid catalyst beds used to effect hydrocarbon conversion and regeneration of catalyst particles. The lift gas to the regenerator may be flue gas with the lift gas into the cracking zone selected from a number of different materials such as hydrogen, methane and unsaturated or saturated normally gaseous products of cracking.

Keith U.S. Pat. No. 2,702,267 discloses a hydrocarbon conversion process which includes stripping of the fouled catalyst with regeneration gases comprising hydrogen. This reference relies upon the use of a steam-high purity oxygen mixture to achieve the known water gas shift reactions to effect a partial removal of deposits of catalytic cracking.

Owen U.S. Pat. No. 3,886,060 discloses an arrangement of apparatus for effecting separate two stage riser hydrocarbon conversion in combination with two stage regeneration of the catalyst employing a first upflowing catalyst regeneration operation followed by a downflowing catalyst second stage of regeneration.

Haddad et al U.S. Pat. No. 4,219,407 discloses discharging a catalyst suspension from a riser zone outwardly and downwardly through channel means open in the bottom thereof. The downwardly discharged catalyst particles are directed into an elongated confined restricting zone provided with sloping baffle means and stripping steam inlet means in a bottom portion thereof.

Pulak U.S. Pat. No. 4,010,003 discloses an apparatus arrangement comprising a catalyst upflow regeneration zone of larger diameter dimensions in a lower portion than the upper portion of restricted diameter used to convey suspended catalyst of regeneration horizontally into an adjacent flue gas-catalyst particle relatively large separation zone provided with internal cyclone separation means. The suspension so horizontally conveyed is directed downwardly by baffle means within the separation zone.

Crude oils from which desired liquid fuels are obtained contain a highly diverse mixture of hydrocarbons, sulfur, nitrogen compounds and metal contaminants of nickel, vanadium, iron, copper, arsenic and sodium. The hydrocarbons vary widely in molecular weight and structure with the hydrogen lean complicated molecular structures concentrated in the higher boiling portion of the crude oil boiling above vacuum gas oils. For example, crude oils are known in which 30 to 60%, or more, of the total volume of oil is composed of compounds boiling at a temperature above 650° F. and in which from about 10% to about 30%, or more, of the total volume comprise molecular structure which boil above about 1000° F. or 1025° F.

Residual portions of crude oil comprising gas oils and high boiling molecular structures boiling above 650° F. are unsuitable for inclusion in gasoline and desired light cycle oil products. Therefore, the petroleum refining industry is required to develop economic processes for converting the higher boiling hydrocarbon structure to form lower boiling desired liquid fuel products of gasoline and light cycle oils which do not boil above a desired product range. The fluid catalytic cracking process (FCC) is the most widely used process to accomplish this purpose.

Crude oils and fractions thereof are normally subjected to pretreatment operations which remove arsenic and sodium to some considerable extent. Also, the heavy metals of nickel, vanadium, iron and copper, which tend to concentrate in the higher boiling portion of the crude oil boiling above about 1025° F. or 1050° F., may be removed partially by one or more methods comprising hydrogenation, delayed coking, solvent extraction and other operations known in the industry. For example, when hydrodesulfurizing the heavier high boiling portion of the crude oil, substantial metal contaminants are removed along with sulfur and nitrogen.

When subjecting the higher boiling portions of crude oil such as a vacuum resid without pretreatment to fluid catalytic cracking, the metal contaminants deposit on the catalyst, thereby reducing it's cracking activity. Other materials such as coke precursors providing Conradson carbon deposits including asphaltenes and higher molecular weight polycyclic structures of 2 to 4, or more, ring compounds break down, leaving deposit on the catalyst, thereby deactivating the catalyst. It has been observed that the heavy metals in the feed transfer almost quantitatively from the feed stock to the catalyst and are not economically removed therefrom, requiring replacement of metals contaminated catalyst with fresh catalyst.

It has been recognized by many in the industry that there is a substantial imbalance in the carbon/hydrogen ratio of the residuum portion of crude oil and such imbalance provides a complex set of technical and economic alternatives to be dealt with. This problem is aggravated substantially by changes in price available to the refiner for the asphalt content of crude oil when it becomes more valuable than refined liquid product such as gasoline, light and heavy liquid fuel oils.

The heavier crude oils are characterized as having a higher concentration of residuum. This residuum portion boiling above vacuum gas oils has a high concentration of nitrogen, sulfur, asphaltenes and higher boiling polycyclic ring compounds including porphyrins, as well as metal contaminants herein identified. A fundamental result of these increased heavy oil residuum components is a lower hydrogen to carbon ratio. However, product demand varies with the seasons and has been directed to providing more saturated middle distillate light oil products including materials readily converted to jet fuels during certain seasons which necessarily requires a substantially higher hydrogen to carbon ratio than is generally available from all residual oil fractions.

In a recent paper entitled "Hydrogen Utilization In Residuum Conversion", presented by Rosenthal et al, Chevron Research Company, at the 48th Midyear Refining Meeting, Session on Heavy Oils Processing, Tuesday, May 10, 1984, Los Angeles, Calif., reference is made to information developed by B. E. Stangeland of Chevron Research, concerned with the variation of hydrogen to carbon ratio with increasing molecular weight of crude oils and hydrocarbon fractions thereof. A chart developed by Stangeland shows the extent to which the carbon number must be reduced and sufficient hydrogen added to generate a desired light feed stock. This illustrates the importance of hydrogen addition when producing mid-distillates gas oils and lube oils. Such materials are characterized by quite low aromatic levels and desirably of high hydrogen content. The impact of using four different primary residuum processing steps on the hydrogen content of the raw liquid products obtained is graphically shown in FIG. 2 of the paper. The four processing steps chosen to demonstrate by comparison the concept were delayed coking and fluid coking (thermal processes) and FCC (fluid catalytic cracking) and residuum hydrodesulfurization as examples of catalytic processes. FIG. 2 clearly shows that the thermal processes produce lighter oils. However, these lighter oils are also much lower in hydrogen content and less than that desired in a middle distillate product fraction. Fluid coking offers the production of more liquid, but the liquid is of a lower hydrogen content than that obtained from delayed coking.

A fluid catalytic cracking operation is identified as producing high conversions, but yields products with relatively low hydrogen content. A residuum desulfurization (RDS), on the other hand, produces relatively light products that have a relatively high hydrogen content when obtained at lower residuum conversion levels.

The information above identified in the referenced paper shows indirectly and directly that a refiner has the choice of adding hydrogen to the product obtained at high yields in one or a combination of heavy oil pretreating and hydrofining steps bordering a primary conversion step of catalytic cracking.

The combination operation of the present invention and method of utilization is concerned in substantial manner with improving the hydrogen to carbon ratio of products of fluid catalytic cracking.

SUMMARY OF THE INVENTION

This invention is directed to the method and arrangement of apparatus for effecting the catalytic conversion of hydrocarbons boiling above 400° F. or 600° F. to produce liquid fuel products boiling below about 650° F. or 600° F. and comprising gasoline, light cycle oils and gaseous components convertible to liquid fuel products. In another particular aspect, the present invention is directed to providing a relatively low apparatus profile arrangement and a selected method of utilization for upgrading residual portions of crude oils boiling above 400° F. and more usually above 500° or 650° F. Thus, it is contemplated processing oil feeds comprising an end boiling point above 1025° F. comprising metal contaminants and contributing Conradson carbon deposits. On the other hand, it is also contemplated processing a residual portion of crude oil provided with an end boiling point less than 1200° F. and more usually not above about 1100° F. In yet a further aspect, the catalytic cracking operation of this invention is directed to a split feed riser cracking operation in which a light oil fraction is subjected to catalytic cracking in at least one riser zone under selected more optimum catalyst to oil ratio temperature and contact time conversion conditions. A higher boiling oil fraction of the crude oil is catalytically cracked in a separate riser zone under particularly selected operating conditions of time, temperature and catalyst to oil ratio more particularly optimizing conversion of the higher boiling fraction to selected and desired lower boiling liquid products. Thus, in one embodiment of this invention, a fraction with an end boiling point in the range of 650° or 800° F. comprising a middle distillate with or without light vacuum gas oil is subjected to catalytic cracking in one riser zone with a higher boiling gas oil containing fraction being catalytically converted in a separate second riser conversion zone with or without the presence of vacuum resid, a product of coking or a solvent extracted fraction thereof. It is also contemplated in another embodiment of converting a light vacuum gas oil and a lower boiling fraction boiling above straight run gasoline charged together or separately to a first riser catalytic cracking zone comprising catalyst suspended in $H_2$ containing gas.

A higher boiling vacuum gas oil alonw or in combination with vacuum resid is charged together or separately to a second separate riser cracking zone for catalytic upgrading in the presence of a hydrogen containing fluidizing gas and diluent lift gas.

In any of the oil feed processing combinations herein identified, it is further contemplated prehydrogenating either one or both of the feeds charged to the separate riser catalytic cracking zones. On the other hand, only the higher boiling residuum containing feed portion to be catalytically cracked is prehydrogenated to remove some sulfur and nitrogen and some metal contaminants from the feed in addition to effecting hydrogenation of multi-cyclic ring compounds in the heavy feed prior to effecting catalytic cracking thereof. It is particularly contemplated charging an atomizing diluent gasiform material with the oil feed to also reduce it's partial pressure when charged to a riser reactor. Diluents such as steam, hydrogen, $CO_2$ mixtures, dry gas, wet gas, low boiling materials known as carbon-hydrogen fragment contributors such as a lower alcohols of methanol, ethanol or prepanol, light olefins and hydrogen transfer materials are premixed particularly with the higher boiling feed portions to be catalytically cracked. Such diluents also desirably reduce the oil feed partial pressure in the catalytic conversion section of a riser.

The catalytic conversion of the different oil feeds herein identified necessarily require the use of a highly versatile operation responsive to seasonal changes and products desired. Also, the arrangement of apparatus employed must provide versatility. That is, the variations in coke (carbonaceous material) deposition will vary considerably depending on the combination of oil feeds processed, the heat balance required by a given operation, protection of the catalyst employed against excessive hydrothermal deactivation and providing sufficient catalyst at a desired elevated temperature needed to vaporize and convert the highest boiling components in the feed charged to a given riser zone. The more refractory components of the oil feed require selective conditions to accomplish conversion thereof to gasoline and light cycle oil liquid products.

The catalytic conversion of residual portions of crude oils is known to include a combination of reactions comprising dehydrogenation, hydrogenation, hydrogen transfer, cyclization, isomerization and the cracking of high molecular weight structures comprising asphaltenes and other orders of cyclic compounds in the oil feed. Thus, it is important to use catalysts which promote the reactions desired with a high degree of efficiency and rate providing a desired product.

Many different catalyst compositions are suggested in the prior art for achieving a selective cracking of a given oil feed. That is, crystalline zeolites (aluminosilicates) of many different compositions and pore structures are available which are used alone or in combination with one another and dispersed in the range of 10 to 50 or more wt. % in a matrix composition normally siliceous in combination with one or more components providing cracking activity or no cracking activity.

Faujasite type crystalline zeolites of the X and Y type catalytically activated by exchange techniques to provide hydrogen or rare earth exchanged forms thereof and combinations thereof appear to be the most popular zeolite containing catalyst used in catalytic cracking of oil feeds. Provisions are made in the prior art to use from 1 to 90 wt. % of the zeolite in a suitable matrix material. Also, provisions are made in the prior art to passivate known metal contaminants of nickel and vanadium deposited on the cracking catalyst by the oil feed during catalytic cracking, thereof. The metal contaminants are identified in the prior art as nickel, vanadium, iron, copper, arsenic and sodium as the most prevalent contaminants. It is recognized by the prior art that the cracking catalyst employed will become deactivated by the deposition of these metal contaminants thereby providing a catalyst composition below a desired equilibrium catalyst activity known as the MAT activity. To rectify this condition with and without contaminant metal passivation, it is necessary to replace used or spent catalyst with fresher catalyst intermittently or continuously. Generally, catalyst replacement, depending on the feed being processed, will be within the range of 0.5 to 3 lbs. of catalyst per barrel of charged oil feed. It is desirable to maintain the catalyst replacement rate as low as possible, however, for ecomomic reasons.

The versatile combination catalytic cracking-regeneration operation of this invention is adaptable, therefore, to using any satisfactory crystalline zeolite (aluminosilicate) catalyst and combinations, thereof, of predetermined and selected cracking activity. Furthermore, the method and arrangement of apparatus of this invention permits achieving a desired and carefully monitored heat balanced operation for a residual oil feed composition being processed. That is, the combination of regeneration operations provided may be restricted from exceeding a temperature limit in the range of 1500° to 1600° F. in both stages of regeneration or just the first stage with the second stage of regeneration being permitted to exceed 1600° F. in some special operations to achieve a desired residual coke reduction on the regenerated catalyst The heat balance of the regeneration operation of this invention is controlled in response to the oil feeds being catalytically cracked, the amount of carbonaceous deposit and, thus, in substantial measure by the oxygen cncentration provided in each step of the regeneration operation. This may or may not be implemented by providing steam admixed with a selected oxygen rich gas, a CO combustion promoting additive admixed with the catalyst and/or combinations thereof charged to the separate stages of catalyst regeneration discussed herein. Some liquid water may also be added as required directly to the first stage of catalyst regeneration to restrict the temperature thereof below that causing substantial hydrothermal catalyst damage. The sequence of regeneration operations and apparatus arrangements are also adaptable to suitable prior art temperature restrictions in the range of 1200° to 1400° F. without the need for providing expensive catalyst cooling by indirect heat exchange means in the regeneration zone or between regeneration zones. The addition of water and/or steam with oxygen restriction to the first stage of catalyst regeneration will produce a flue gas comprising CO, $CO_2$, and $H_2$ absent a combustion supporting amount of oxygen. Thus, the water gas shift reaction is promoted substantially by providing a steam to oxygen ratio greater than one and more usually within the range of about 2 to 4. Thus, some partial combustion of carbonaceous material and conversion, thereof, with oxygen lean gas and $CO_2$ in conjunction with promoting the important water gas shift reaction between $CO+H_2O+CO_2+H_2$ is particularly promoted in a first stage of catalyst regeneration. An operating temperature environment is achieved by mixing high temperature regenerated or partially regenerated catalyst and suspending the mixture in a preheated mixture of steam and oxygen lean gas at an elevated temperature up to about 1000° F. An initially formed suspension of catalyst particles and reactant gas, above discussed, is charged into a bottom portion of a rising fluid phase or mass of catalyst particles being partially regenerated as herein provided. The fluid phase of catalyst particles is maintained in a particle concentration in the range of 10 to 35 lbs/cu. ft. The catalyst particles, thus partially regenerated, are thereafter contacted with a gaseous mixture which removes products of the water gas shift reaction comprising formed hydrogen from the catalyst before passage of the catalyst to a second stage of regeneration, wherein the catalyst is contacted with oxygen rich gas in the absence of steam to achieve desired further removal of residual coke deposits. The removal of any entrained hydrogen from partially regenerated catalyst is preferably accomplished with gaseous material which maintained the temperature of the partially regenerated catalyst at least 1400° F. A gaseous material suitable for this purpose includes an oxygen lean gas of little or no steam content and preferably a high temperature $CO_2$ flue gas product of regeneration comprising little, if any, oxygen.

The catalyst thus partially regenerated as above discussed, is withdrawn at an elevated temperature in the range of 1400° F. to 1600° F. and preferably at a temperature of 1450° or 1500° F. for cascade to a second stage of catalyst regeneration without encountering any significant temperature reduction. The second stage of catalyst regeneration is preferably accomplished with oxygen containing gas in the absence of steam to achieve combustion removal of carbon deposits on the partially regenerated catalyst to a residual coke level below 0.25 wt. % and preferably to about 0.1 wt. %. The second stage of regeneration comprises a riser regeneration zone. The second stage riser regeneration zone may or may not be of a uniform diameter throughout the length thereof. It is shaped, however, in a restricted diameter section as a half circle adjacent the upper terminal end thereof to discharge a regenerated catalyst high temperature suspension downwardly through the top of a relatively large regenerated catalyst disengaging and accumulation zone. It is contemplated recycling some recovered second stage regenerated catalyst particles to the riser inlet thereof for admixture with the partially regenerated catalyst passed thereto from the first stage of regeneration. An oxygen containing gas of higher oxygen concentration than that used in the first stage of regeneration is charged to the second stage riser regeneration zone.

The regeneration gas used in the second stage is preferably an oxygen rich gas which rapidly achieve combustion of residual carbon on the partially regenerated catalyst and maintained at a temperature at least in the range of 1400° to 1600° F. The second stage of regeneration with oxygen rich regeneration gas is intended to produce $CO_2$ rich flue gases comprising some unconsumed oxygen less than a significant amount. The oxygen lean first stage of regeneration produces a flue gas comprising CO, $CO_2$ and substantial hydrogen. The amount of hydrogen produced will depend upon the reactions of steam and $CO_2$ with carbon and the promotional effect of nickel on the catalyst.

The separated and recovered high temperature regenerated catalyst of the second stage at a temperature in the range of 1400° F. up to 1600° F. obtained in the absence of steam is collected as a fluid bed of catalyst in a lower bottom portion of the separation zone preferably of limited inventory and maintained in downflowing dense fluid phase condition. An inert gas such as $CO_2$ is charged to a bottom portion of the collected bed of catalyst. In the event the regenerated catalyst is recovered at a temperature above that desired for use in one or both of the hydrocarbon conversion riser cracking zones, some indirect cooling of the catalyst may be accomplished or with the fluidizing gas charged, thereto. Indirect cooling of the regenerated catalyst may be had in the standpipes used to pass regenerated catalyst to each of the riser hycrocarbon zones herewith discussed. It is contemplated passing as required a portion of the collected regenerated catalyst of the second stage of regeneration to a bottom portion of the riser regeneration zone for admixture with the partially regenerated catalyst charged thereto.

Conversion of a hydrocarbon oil feed material comprising gas oils with or without vacuum resid and treated as herein provided is accomplished in one or more riser hydrocarbon conversion zones in the presence of fluid catalyst particles and one or more gasiform diluent materials selected from steam, hydrogen containing gaseous products of hydrocarbon conversion or other available source material and comprising $C_3$ or $C_5$ and lower boiling components. The gasiform diluent material may also be one of carbon-hydrogen fragment contributing material such as a lower alcohol selected from methanol, ethanol, or propanol, it being preferred to employ a material contributing little carbon deposition on the freshly regenerated high temperature catalyst. A formed suspension of hydrocarbons, catalyst and diluent material contributing substantially to atomization of the oil feed prior to contact with the catalyst and reduction in the oil feed and product partial pressure passes upwardly through the riser conversion zone at a velocity providing a hydrocarbon vapor residence time within the range of 0.5 to about 2 or 3 seconds, but preferably not substantially above a time in the range of 1 to 2 seconds before discharge from the end thereof at a temperature within the range of 900° to 1150° F. and more usually in the range of 950° F. to about 1050° F. or 1100° F. Some quenching of the vaporous hydrocarbon conversion products may be accomplished in a down stream section of the riser reaction zone by charging an atomized light cycle oil product of the cracking operation, a middle distillate fraction of atmospheric distillation or other material suitable for the purpose. In one embodiment, it is contemplated charging steam alone as the quench fluid or in combination with an atomized oil material above identified.

The upper discharge end section of the riser reactor is preferably of a smaller diameter than a lower section thereof and shaped to provide for horizontal tangential discharge into an inverted cup section positioned within a large suspension and product recovery zone. The discharge section of the riser may be curved to accomplish the above or as a half circle pipe section to provide for downward discharge as disclosed in applicants parent application. On the other hand, the upper end section of the riser may be formed of straight conduit sections positioned at right angles to one another to accomplish discharge of the suspension therein from the end thereof as herein provided. In any of these arrangements the formed suspension passing upwardly through the riser reactor encounters some separation in the downstream section of the riser reactor and before discharge from the open end thereof into the large separation zone. Centrifugal separation of the suspension is particularly desirable upon discharge into the large separation zone. In any of these discharge arrangements, the catalyst solids are encouraged to separate and fall into a bottom portion of the large separation zone which is in open communication with a stripping zone adjacent to the large separation zone. The product hydrocarbon vapors and diluent gasiform material separated from suspended catalyst is encouraged to pass directly into cyclone separation zones located adjacent the riser discharge open end. Such encouragement may be accomplished by reducing the cyclone internal pressure below that in the large velocity reducing zone. Thus, the combination of substantial velocity reduction and reduced pressure in the cyclones encourages the vaporous products to separate from catalyst particles discharged at a momentum vector greater than the vapors. The catalyst particles separated from vaporous material comprising hydrocarbon conversion products pass downwardly through the large separation zone and into a stripping zone generally positioned therebelow as shown in the drawings. In this arrangement the falling catalyst particles pass countercurrent to stripping gas and stripped products. Therefore, it is important to control the stripping gas velocity below that entraining a significant quanity of catalyst particles into the cyclones.

In the riser discharge apparatus arrangement above described, the cyclone inlet of a plurality of cyclones is located to particularly encourage the flow of vapors absent catalyst particle entrainment into the cyclones for further separation of entrained catalyst fines with product vapors. When employing a half circle section in the end section of the riser as disclosed in the parent application it is contemplated providing a baffle substantially within and across the riser adjacent the end thereof and positioned to maintain and concentrate centrifugally separated catalyst particles on the outer side of the half circle section and away from separated vapors confined to the inside of the circular section. Thus, the suspension velocity entering the half circle of the riser discharge section should be sufficient to achieve the desired centrifugal separation of suspended solids from vapors but the velocity should not be so high that vapors are not separated from solids and are discharged downwardly into a lower section of the larger separation zone for recontact beyond the inlet to the cyclone separation zones. The cyclones are preferably maintained at a pressure below the pressure in the relatively large disengaging zone to encourage vapor to flow through the cyclones. A stream of centrifugally concentrated solids are projected downwardly and away from the vapor inlet to the cyclones. This trajectory of solids away from the cyclone inlet is implemented by downwardly extending the baffle means provided beyond the cyclone inlet so that the catalyst particles enter the upper open end of a cylindrical zone confining the discharged catalyst particles.

It is preferred that the stripping zone temperature be maintained above about 900° F. and preferably at least 1000° F. or more. Thus, an elevated stripping temperature may be implemented by charging a hot $CO_2$ product of the catalyst regeneration operation to the stripper, adding hot regenerated catalyst to the spent catalyst and stripping the mixture in a separate stripping zone with steam and/or $CO_2$ at a temperature of at least 1200° F. or more. Stripping of the catalyst discharged from the riser conversion zones is accomplished in one particular embodiment with a hot $CO_2$ product of catalyst regeneration free of combustion supporting amounts of oxygen or with a hydrogen rich gas of water gas shift obtained from the first stage of regeneration of this invention. Thus, the stripping gas may be obtained from the flue gas of the first or second stage of regeneration or from a CO boiler zone not shown and used to generate process steam by combustion of CO rich gas recovered from a first stage oxygen lean gas catalyst regeneration, herein discussed. Stripping of the catalyst may be accomplished with $CO_2$ alone and separately charged to two different levels of the stripping zone or steam may be used to strip the catalyst in a lower portion of the stripping zone with hot $CO_2$ being charged to an upper portion of the stripping zone. The catalyst,-thus stripped,is then passed to the first stage of catalyst regeneration,herein discussed,for admixture with partially regenerated catalyst and lean oxygen containing regeneration gas comprising steam to form a mixture thereof sufficiently temperature elevated to initiate rapid conversion of the hydrocarbonaceous deposits of oil conversion on the catalyst particles.

The first stage of catalyst regeneration comprising the combination operations of this invention is accomplished in a relatively dense fluid bed catalyst phase such as made available in an apparatus arrangement positioned side by side similar to tthat known as the Model IV fluid catalyst cracking system or in a stacked arrangement such as the Orthoflow Model C system known in the refining industry. In each of these systems the catalyst being regenerated moves generally upward as a dense fluid mass of catalyst particles in the regenerator before withdrawal therefrom. In either of these arrangements, it is contemplated employing an oxygen lean regeneration gas with or without steam under conditions which will substantially curtail the regeneration temperature encountered. That is, the temperature will be curtailed within the range of 1200° to 1500° F. and more usually an upper temperature of about 1400° F. will not be exceeded except when it is desired to promote the known water gas shift reactions, then the temperature will be permitted to be in the range of 1400° to 1500° F. to effect partial removal of hydrocarbonaceous deposits by water gas shift reactions without causing hydrothermal damage to the crystalline zeolite containing cracking catalyst. More importantly it is important to restrain the first stage regeneration temperature below that causing thermal damage to the available equipment for the purpose.

A second imdependent and sequential stage of regeneration is provided and designed to permit the use of higher regeneration temperatures. That is, the second stage of catalyst regeneration may be equal to or above the temperature of the first stage of regeneration and may be within the range of 1300° F. to 1600° F. However, the second stage of regeneration is preferably accomplished with oxygen rich gas in the absence of steam to avoid hydrothermal damage of the catalyst when retaining little, less than 0.25 wt % coke, or no residual coke on the catalyst. The catalyst recovery zone of the second stage regeneration operation is thus designed to minimize the use of expensive alloys and exposed to temperatures exceeding about 1500° F. The use of refractory lined vessel equipment and transfer conduits is thus employed which will accept temperatures as high as about 1600° F. Designs suitable for this purpose are particularly shown in the attached drawings.

In the combination regeneration operation herein disclosed, it is contemplated removing from 50 to 90 wt % of the hydrocarbonaceous deposits in the first stage of regeneration, and more usually from 60 to about 80 wt % thereof in the first regeneration stage. The coke remaining on the catalyst following the first stage of regeneration is removed in the second stage in the amount desired. In this operating regeneration environment, only the partially regenerated catalyst is recycled for admixture with spent catalyst charged to the first stage of regeneration. Also, only the regenerated catalyst recovered from the second stage of regeneration is recycled to the second stage for admixture with the partially regenerated catalyst passed to the second stage of regeneration. This operating technique reduces substantially the chance of causing hydrothermal damage to the catalyst recovered from the ultimate stage of regeneration that could occur if passed to the first stage of regeneration with the spent catalyst.

It is contemplated in an embodiment of this invention of effecting the first stage of catalyst regeneration in the absence of added steam under conditions to produce a $CO_2$ rich flue gas by adding a CO combustion promoter to the catalyst. On the other hand, when the heat balance of the combination operation is critical, due to effecting catalytic cracking of Conradson carbon contributing oil feeds and residual portions thereof, the first stage of regeneration may be accomplished with an oxygen lean gas and under conditions to produce a CO rich flue gas. This may be helped by addition of steam quenching of the CO rich flue gases in the cyclones to prevent after burning from occurring therein.

In any of the above identified catalyst regeneration operating concepts, it is essential to select operating conditions which will maintain the catalyst activity at a high desired level.

The catalyst regeneration concepts of this invention recognize the heat of combustions contributed by combusting hydrogen, CO and coke as shown in the table below. The regeneration operation is accordingly controlled.

HEAT OF COMBUSTION, BTU/lb COKE

| | Percent $H_2$ in Coke | | |
|---|---|---|---|
| $CO_2$/CO Ratio | 2 | 4 | 6 |
| 0.5 | 8362 | 9472 | 10582 |
| 1.0 | | 11038 | 12083 |
| 3.0 | | | 14446 |

-continued

| HEAT OF COMBUSTION, BTU/lb COKE | | | |
|---|---|---|---|
| | Percent $H_2$ in Coke | | |
| $CO_2/CO$ Ratio | 2 | 4 | 6 |
| 4.0 | 12912 | | 14894 |

It will be recognized by those skilled in the catalytic cracking art that the combination operation of this invention is adaptable to many different feed compositions, catalyst compositions and operating process variations without departing substantially from the spirit and scope of this invention. It will also be realized by those having considerable knowledge of the prior art that the discussed regeneration techniques of this invention encompassed to some extent that disclosed in U.S. Pat. No. 2,702,267, issued 2/15/55. This reference discusses some basic known reactions in which catalyst comprising coke deposits may be partially regenerated by removing coke with a mixture of steam and high purity oxygen at a regeneration temperature above 1400° F. and preferably up to about 1600° F. Thus, carbonaceous deposits (coke) are eliminated from a cracking catalyst with steam in combination with oxygen to some considerable extent and product gases comprising hydrogen, carbon oxides and excess steam may be recovered. The principal and known reactions are:

(A) $2C+O_2=2CO$
(B) $C+O=CO$
(C) $C+CO_2=2CO$
(D) $C+H_2O=CO+H_2$
(E) $CO+H_2O=CO_2+H_2$

Reactions A, B and E are exothermic while C and D are endothermic. Achieving a proper balance between these reactions to achieve partial regenerationof the catalyst is part of this invention.

The above prior art is supplemented in part by a paper entitled "Reactions Of Steam With Coke On Solid Substrates" by T. Y. Yan et al, presented before the Division of Petroleum Chemistry, Inc.; Washington Meeting; Sept. 9-14, 1979. This paper addresses the subject of reaction of steam with coke deposits without oxygen on silica alumina at temperatures in the range of 1400° F. to 1600° F. and the influence of Ni, V, Fe and Cu on the reaction at 1500° F. Nickel accelerated the initial gasification rate but the other metals had no significant effect; it being speculated that they formed a complex with the silica alumina catalyst. This method of collecting the other metal contaminants of V, Fe, Cu and other methods discussed in the prior art is particularly desired when processing residual portions of crude oil comprising substantial metal contaminants.

The regeneration operating conditions of this invention may be modified to exclude or include, to some considerable extent, the above prior art reaction mechanism. It is preferred to achieve oxygen combustion exothermic reactions sufficient to support the endothermic reactions above identified, when exposing the catalyst to high temperature steam only when the catalyst comprises substantial carbonaceous deposits such as in the first stage of regeneration in order to minimize hydrothermal damage to the catalyst. Thus, the second stage of catalyst regeneration is accomplished in the absence of steam with oxygen rich gas such as air or an oxygen enriched gas to achieve high temperature combustion removal of residual coke without exposing the catalyst to hydrothermal damage.

In an embodiment of this invention above identified, it is contemplated subjecting a heavy high boiling portion of crude oil such as a vacuum resid to solvent extraction to reject asphaltenes and resins with a known solvent such as propane, butane, pentane or hexane and combinations thereof. On the other hand, a solvent extraction-deasphalting process providing a deep solvent deasphalting (DSDA) operation with butane, pentane and hexane may be employed to increase the yield of oil components suitable for catalytic cracking. In yet another aspect, when deasphalting a long boiling range feed mixture, it is contemplated employing a mixture of propane and butane under liquid phase extraction conditions. Thus, an atmospheric tower bottoms fraction of crude oil and comprising an initial boiling point in the range of 700° to 800° F. or that portion of the crude comprising heavy vacuum gas oil may be charged as the feed to the solvent deasphalting operation to increase the yield of contaminant metals removal. Thus, the choice of the feed to the deasphalting operation will depend upon the source of the crude oil to be upgraded by the combination operation of this invention.

In a particular aspect, it is contemplated providing and using a solvent deasphalting operation at a severity accomplishing recovery of an oil extract phase by volume of residuum in the range of about 80 to 95% and an asphalt phase or solvent reject phase within the range of 5 to 20% asphalt components by volume of residuum. When pursuing a deep solvent deasphalting operation of vacuum resid, it is preferred to use a hydrocarbon solvent of a molecular weight in the range of 50 to 85 and in an amount which will precipitate from 5 to about 10 volume percent or more of the asphalt components of the residuum.

It is further contemplated cracking an oil product of delayed coking of reduced metals, sulfur and nitrogen content or a liquid product of coal solvation comprising naphthalene ($C_{10}H_8$) and it's isomers particularly after effecting a relatively mild or severe hydrogenation treatment sufficient to achieve some hydrocracking thereof accompanied by hydrogenation.

Effecting a hydrogenation treatment of the heavy oil feed components as above discussed effects a parital removal of entrained metal contaminants of Ni, V, Fe and Cu in the high boiling feed components. This hydrogenation treatment accompanied by the deasphalting operation also reduces the feed Conradson carbon contributing components to at least 5, and more usually in the range of 2 to 4. The obtained reduction in metal contaminants carried with the feed to the heavy oil riser cracking step reduces the rate of contaminants metals accumulation on the catalyst thereby contributing to a lower catalyst replacement rate and the accumulated metals may be passivated by techniques known in the art by a lower rate of passivating agent addition contributing substantially to the economics of the process.

The combination of apparatus identified and described herein is preferably sized to provide a relatively low profile system of relatively low velocity and circulated catalyst inventory per barrel of feed charged.

BRIEF DESCRIPTION OF THE DRAWINGS

FIG. I is a diagrammatic sketch in elevation of a side by side arrangement of vessels comprising sequential two stage catalyst regeneration adjacent dual riser hydrocarbon conversion zones for effecting the catalytic conversion of selected portions of a crude oil which has been deasphalted and/or hydrogenated to remove asphaltic components, feed metal components, sulfur and nitrogen compounds.

FIG. II is a diagrammatic sketch in elevation of a modified Model "C" Orthoflow apparatus system to provide for two stage catalyst regeneration, one or more stages of riser hydrocarbon conversion of a deasphalted oil fraction with or without hydrodesulfurization of vacuum gas oils and a higher boiling deasphalted oil fraction.

DISCUSSION OF SPECIFIC EMBODIMENT

Referring now to FIG. I by way of example, there is provided a side by side combination system or operation for upgrading fractions of crude oil and effecting a controlled regeneration of catalyst particles used therein. A crude oil is charged to the process by conduit 1 to an atmospheric distillation tower 3. A gaseous fraction is recovered from tower 3 by conduit 5, a naphtha by conduit 7, a kerosene fraction by conduit 9, a middle distillate by conduit 11 and an atmospheric bottoms by conduit 13, The atmospheric bottoms may be recovered with an initial boiling point (IBP) within the range of 600° to 700° F., depending on the boiling range selected to be recovered as middle distillate. The middle distillate may be passed to catalytic cracking during seasonal or other requirements for high gasoline product yield. On the other hand, the middle distillate may be passed by conduit 23 to hydrogenation zone 25 to effect hydrogenation and desulfurization, thereof, in preparation of a liquid fuel product higher boiling than gasoline of restricted aromatic content.

The atmospheric tower bottoms in conduit 13 is passed to a vacuum distillation tower 15 maintained under temperature and restricted pressure conditions permitting the recovery of a light vacuum gas oil by conduit 17, a heavy vacuum gas oil recovered by conduit 19 and a vacuum resid recovered by conduit 21. The vacuum resid comprising asphaltic material, metal contaminants, porphyrins and particularly polycyclic asphaltene components is passed to deasphalting zone 27.

Deasphalting of the vacuum resid is accomplished preferably with one of butane or pentane to accomplish deep solvent deasphalting (DSDA) of the vacuum resid similar to that accomplished by the Rose® Process. The Rose® Process is described in "World Oil & Gas Show and Conference", December 1981, Mr. J. A. Gearhart of Kerr-McGee and accomplishes high yields of oil product material distinguishable from the resin and asphaltene components of asphaltic material. In this deasphalting operation substantial metal contaminants are removed along with sulfur and nitrogen.

The deasphalted oil product of reduced metals content is then withdrawn by conduit 29. It may be passed to a hydrodesulfurization zone 31 for hydrogenation thereof, wherein additional metal contaminants and sulfur will be removed or it may bypass the hydrogenation-desulfurization zone by conduit 33 for passage to a riser hydrocarbon conversion zone. The heavy vacuum gas oil in conduit 19 may also be passed to hydrogenation-desulfurization zone 31 alone or admixed with the deasphalted oil in conduit 29. On the other hand, the heavy vacuum gas oil may by-pass zone 31 by conduit 35 and be passed to a riser oil feed conversion zone by conduit 37. Thus, the oil feed to riser conversion zone 39 is a heavy vacuum gas oil in admixture with an oil product of deep solvent deasphalting either with or without further hydrogenation treatment to remove metal contaminants of Ni, V, Fe and Cu along with sulfur and nitrogen. The purity of the heavy oil charged and processed as above discussed may be further improved by effecting desalting thereof, prior to atmospheric distillation as usually practiced in the refining art.

In riser cracking zone 39, a suspension of regenerated catalyst at a temperature within the range of 1300° to 1500° F. is formed with a lift gas in conduit 49 preferably one comprising hydrogen for introduction to and upflow through riser 39. The heavy oil feed in conduit 37 at a temperature from 350° to 650° F. and mixed with an atomizing gasiform material in conduit 41 such as $C_5$-product gases, $C_3$-product gases, lower alcohols, $CO_2$ or a combination thereof is charged to the riser 39 in atomized contact with the upflowing catalyst suspension to achieve substantially instantaneous vaporization and conversion of charged atomized oil droplets. The operating condition of catalyst to oil ratio, catalyst temperature, oil feed partial pressure, and hydrocarbon vapor residence time in the riser is selected to provide product vapors at a temperature in the range of 900° to 1100° F. during a residence time less than 3 seconds and more usually within the range of 0.5 to 2 seconds. It is preferred to avoid using steam to atomize the heavy oil feed or contact the hot catalyst charged to the riser to restrict hydrothermal damage to the catalyst caused by such contact.

The light vacuum gas oil in conduit 17 with or without the middle distillate in conduit 11 is charged to a second separate riser conversion zone 43 following admixture with atomizing diluent material charged by conduit 45. The diluent in conduit 45 may be one of those referred to and used with respect to conduit 40. It is further contemplated admixing one or both of (LCO) light cycle oil or (HCO) heavy cycle oil charged by conduit 47 to the oil feed charged by conduit 17 depending on product demand. The oil feed mixture charged by conduit 17 and admixed with atomizing diluent gasiform material contacts a rising suspension of catalyst particles at a temperature in the range of 1300° to 1500° F. in a lift gas charged by conduit 51. The lift gas may be selected from a lift gas discussed with that used in conduit 49. Regenerated catalyst obtained as herein discussed is charged by conduit 53 for admixture with lift gas in conduit 49 charged to riser 39. Regenerated catalyst is charged by conduit 55 for admixture with lift gas in conduit 51 and charged to riser 43.

In the specific arrangement of FIG. I the suspensions comprising hydrocarbon conversion product vapors, diluents and fluid catalyst particles in each of riser 39 and 43 pass from the upper end of each riser through restricted diameter transfer conduit sections 57 and 59 curved and discharging generally horizontal and tangentially into restricted diameter cylindrical zones 61 and 63 respectively adjacent the inside vertical wall of a large catalyst separation and recovery zone 65. The restricted diameter cylindrical zones are open in the bottom thereof to the large catalyst separation and collection zone through which the centrifugally separated catalyst falls following tangential separation from product vapors. Vaporous material centrifugally separated from catalyst is passed upwardly through open end withdrawal passageways 67 and 69 respectively and communicating with a plurality of parallel arranged two stage cyclone separation zones and withdrawal therefrom as a combined product streams by conduit 71 communicating with a product fractionater 73. The withdrawn vaporous products are separated into a gaseous product, gasoline, light cycle oil, heavy cycle oil and a slurry oil product each separately recovered from fractionation zone 73.

A lower section of zone 65, generally of smaller diameter, is known as the catalyst stripping zone. The stripping zone is provided with a staggered arrangement of downwardly sloping baffle means by which downwardly flowing catalyst particles are passed and counter current to stripping gas such as steam, $CO_2$ and mixtures thereof charged by conduit 75 to a bottom section of the stripping zone. The stripping gas and any stripped vaporous product material passes upwardly from the bed of catalyst in the stripping zone for recovery by the cyclone separation means provided by passing upwardly through cylindrical zones 61 and 63 or into separate cyclone separation means not shown with inlet thereto outside of zones 61 and 63.

The stripped catalyst particles comprising hydrocarbonaceous deposits of the risers hydrocarbon conversion operation is recovered from the bottom of the stripping section and conveyed by a sloping standpipe 77 to a riser conduit 79 discharging into a bottom portion of a dense fluid bed of catalyst in a first stage of catalyst regeneration. An oxygen lean combustion supporting regeneration gas with or without added steam as herein provided is charged to riser 79 by conduit 81. Partially regenerated catalyst is also charged by conduit 83 to riser 79 for admixture with the spent catalyst to raise it's temperature thereof above about 900° F. and sufficient to initiate combustion rapidly of hydrocarbonaceous deposits by the charged oxygen lean combustion supporting gas. Thus, the partially regenerated catalyst at a temperature in the range of 1200° to 1400° F. admixed with oxygen lean regeneration gas preferably preheated to an elevated temperature up to about 1000° F. is mixed with the cooler spent catalyst to form a rising suspension in riser 79 which rapidly effects combustion of the hydrogen in the hydrocarbonaceous deposits as well as carbonaceous deposits thereon. The suspension thus formed is discharged by riser 79 into the bottom portion of a dense fluid bed of catalyst being regenerated as the catalyst particles move generally upward in this first stage of catalyst regeneration. The catalyst thus partially regenerated with oxygen lean gas charged by conduit 81 along with that charged by conduit 85 to the lower portion of bed 87 pass over the top of baffle means 89 into an annular mass of catalyst comprising the upper portion of bed 87. A portion of this partially regenerated catalyst is withdrawn by conduit 83 for recycle as above provided. A second portion is withdrawn by conduit 91 for passage to a second stage of catalyst regeneration discussed below.

Flue gas products of the first stage of catalyst regeneration comprising CO and $CO_2$ with or without hydrogen and steam as herein discussed depending on whether water gas shift is particularly promoted pass from the upper catalyst bed surface and through cyclone separation zones 93 positioned in the upper portion of regeneration vessel 95 into a plenum chamber 97 and withdrawal therefrom by conduit 99. It is contemplated adding stream to the upper dispersed phase of regeneration zone 95 alone or in combination with addition thereof to one or more cyclones to suppress combustion of CO should there be a break through of oxygen lean gas into the dispersed phase of the regeneration zone.

The partially regenerated catalyst withdrawn by conduit 91 and at a temperature in the range of 1200° to 1400° F. is passed to the lower portion of a riser or transport zone second stage catalyst regeneration. The partially regenerated catalyst particles is mixed with more completely regenerated catalyst particles charged by standpipe 101 and oxygen rich regeneration gas charged by conduit 103 after preheating to a desired elevated temperature up to about 1000° F. or higher. A rising suspension of the thus formed mixture is passed upwardly through riser regeneration zone 105 to effect more complete combustion of residual carbonaceous material or coke on the partially regenerated catalyst. The riser regeneration zone 105 may comprise an expanded section throughout a substantial length thereof or the riser may comprise the expanded section in only the lower portion thereof and comprise a more restricted section in an upper portion for conveying a more dilute suspension of the regenerated catalyst into a downstream separation zone. Thus, the suspension of catalyst particles conveyed through riser 105 may be of a particle concentration within the range of 3 to 30 lbs/cu. ft. but more usually is within the range of about 5 to 20 lbs/cu. ft.

The upper restricted diameter section 107 of riser 105 is curved to provide generally horizontal passage and tangential discharge into a cylindrical separation zone 109 for separation of $CO_2$ flue gas product comprising unconsumed oxygen, if any, from centrifugally separated particles of catalyst collected in a bottom portion of zone 109. Flue gas $CO_2$ rich products are withdrawn upwardly through open end passageway 111 in open communication with radiating passageways 113 external to vessel 109. External passageways 113 are open to cyclone separation zones 115 on the outer ends thereof through which the flue gases pass to remove entrained catalyst fines from flue gases recovered from the cyclones by conduit 117. Cyclone separated catalyst fines are passed by diplegs to the mass of collected catalyst in the bottom of zone 109 and comprising the more completely regenerated catalyst at a temperature within the range of about 1400° to 1600° F. The more completely regenerated catalyst may comprise residual carbon thereon in the range of 0.05 up to 0.25 wt % but preferaby is less than about 0.15 wt %. The catalyst thus regenerated and recovered in zone 109 is withdrawn from the bottom thereof by conduit 119 in open communication with conduits 53 and 55 used to convey regenerated catalyst to the separate riser hydrocarbon conversion zones 39 and 43, thus, completing the circulation of catalyst particles through the combination of vessels comprising the system of FIG. I.

FIG. II departs from the arrangement of FIG. I in that a stacked Orthoflow system is modified to encompass many of the processing concepts identified herein before including those expressed during discussion of FIG. I. On the other hand, many of the processing concepts discussed below with respect to FIG. II may also be adapted to FIG. I.

Referring now to FIG. II a desalted crude oil is charged by conduit 2 to an atmospheric fractionation zone 4 wherein a separation is made to recover gaseous material by conduit 6, gasoline boiling range material by conduit 8, kerosene type material by conduit 10, a middle distillate fraction by conduit 12 and a residual oil fraction boiling above about 600°, 650° or 700° F. recovered by conduit 14. The residual oil fraction in conduit 14 is passed to a vacuum distillation zone maintained at a temperature of at least 800° F. and a pressure below atmospheric pressure to effect separation between a light vacuum gas oil recovered by conduit 18, a heavy vacuum gas oil recovered by conduit 20 and a vacuum resid or asphaltic fraction recovered by conduit 22.

The vacuum resid in conduit 22 is passed to a deasphalting operation 24 preferably effected with one of butane or pentane solvent material whereby a greater recovery of oil product is recovered from the asphaltene and resin components in the resid than is normally recovered with a propane solvent material under propane deasphalting conditions. A deasphalted oil product is recovered by conduit 26. The deasphalted oil product and the heavy vacuum gas oil in conduit 20 may be combined or separately treated with hydrogen in a hydrogenation zone and prior to being charged to a riser cracking zone. In the event a single riser hydrocarbon conversion zone is employed the light vacuum gas oil may be combined with the heavier oil feed either before or after hydrogenation of the heavier oil feed. On the other hand, when two separate riser cracking zones are to be employed, the light vacuum gas oil alone or in admixture with the middle distillate fraction in conduit 12 may be combined and passed to a second separate riser cracking zone. In yet another embodiment, it is contemplated passing the vacuum gas oils as a combined stream to one riser cracking zone and combining a portion of the middle distillate fraction in conduit 12 with the deasphalted oil product before or after hydrogenation thereof and passing the mixture thus formed to a separate riser cracking zone. It is further contemplated maintaining the conditions of severity of the hydrogenation operation sufficient to effect a partial hydrocracking thereof. Thus, the hydrogenation operation may be limited to one of desulfurization at a temperature above 600° F. and a pressure not substantially above about 500 psig or the operating pressure and temperature may be increased to at least 1000 psig and the operating temperature restricted to about 800° F.

The oil feed selected and obtained as herein provided, is then charged by conduit 28 following admixture with a gasiform atomizing diluent material in conduit 30 to an expanding transition section of a riser conversion for contact with a catalyst suspension charged to the bottom of the riser conversion zone. That is, a suspension of hot regenerated catalyst particles is formed with a lift gas product of hydrocarbon conversion with or without hydrogen and preferably comprising $C_4$ or $C_3$ minus product gases. Other lift gas material disclosed in the discussion of FIG. I and suitable for the purpose may be used. It is particularly preferred to use a hydrogen containing lift gas when the heavy oil feeds charged have not been subjected to prehydrogenation treatment above discussed.

The riser hydrocarbon conversion zone or zones 32 may be of constant diameter above the oil feed inlet or it may comprise an expanded contact section in a lower portion thereof as shown in the drawing before the suspension and product vapors pass through a more restricted diameter section to a separation zone. Riser 32 of FIG. II, terminates in a horizontal section and a section extending downwardly at the end of the horizontal section which is open in the bottom. However, the horizontal section of riser 32 may be replaced with a half circle section which passes through the vertical wall of the large separation zone 34, or through the top, thereof, to achieve downward discharge of the suspension components passed through the reaction zone. In any of these arrangements, the velocity of the suspension discharged from the bottom open end of the riser discharge should be limited to that encouraging separation of the suspension vaporous components from catalyst particles.

In separation zone 34, the separated vaporous materials pass into and through a pluraltty of parallel arranged two stage cyclone separation zones 36 connected to a plenum chamber 38. The vaporous material is withdrawn from plenum 38 by conduit 40 and passed to a fraction zone 42. In fractionation zone 42, a separation is made to recover a gasoline fraction, a light cycle oil fraction and a heavy cycle oil fraction from a slurry oil fraction and a $C_5$-gaseous product fraction recovered by conduit 44. The gaseous product in conduit 44 is passed to zone 46 comprising a gas processing and concentration plant wherein a separation is made to recover butane rich product recovered by conduit 48, a pentane rich product recovered by conduit 50 and a dry gas product comprising hydrogen such as a $C_3$ minus gas product recovered by conduit 52.

The gaseous product recovered by conduit 52 may be employed as lift gas admixed with regenerated catalyst to form a suspension passed to the riser reaction zone 32. A $C_2$-gaseous product obtained from another source may be charged by conduit 54 to form a suspension with the regenerated catalyst in conduit 56 which suspension is thereafter passed upwardly through riser 32. The gaseous product in conduit 6 recovered from the atmospheric fractionation column 4 may also be charged to zone 46.

When employing more than one riser reaction zone in the apparatus arrangement of FIG. II, it is contemplated processing a combination of oil feeds in a manner similar to that discussed with respect to FIG. I.

The catalyst separated from hydrocarbon product vapors in separation zone 34 is collected as a downflowing fluid mass of catalyst particles flowing countercurrent to stripping gas charged by conduit 58. The stripped catalyst then passes downwardly through standpipe 60 for discharge from the bottom end thereof at a rate controlled by vertically moving plug valve 62 coaxially aligned with the bottom open end of the stand pipe. The catalyst, thus discharged and comprising hydrocarbonaceous deposits of oil conversion, is mixed with an oxygen lean combustion supporting gas charged by conduit means 64 to regeneration gas distributing means 66 positioned in a cylindrical zone defined by vertical wall 68. A suspension "A" of spent catalyst particles and oxygen lean combustion supporting gas which may or may not comprise steam for effecting temperature control is passed upwardly through the cylindrical zone under partial combustion temperature conditions of 1200° F. and a velocity sufficient for the catalyst suspension "A" to overflow the upper edge of the cylindrical zone into an annular bed of catalyst "B" thereabout and downflow in the annular bed "B" countercurrent to oxygen lean combustion supporting gas charged thereto by conduits 70 and 72 attached to distributor means within the annular catalyst bed. The regeneration of catalyst particles by combustion of hydrocarbonaceous deposits with oxygen lean gas in catalyst beds "A" and "B" above discussed is preferably effected over a temperature range of about 1200° F. up to about 1350° F. in the presence of a CO combustion supported metal added to the catalyst known in the prior art to produce $CO_2$ rich flue gases comprising CO in the absence of combustion supporting amounts of oxygen in the flue gases above the dense catalyst bed phase therein and removed through a plurality of cyclone zones 72 to conduit 74. The regeneration operation, thus effected, removes at least 60 wt. % of the hydrocarbonaceous deposits and preferably from 70 to 80 wt. % thereof is removed by the combination of catalyst beds "A" and "B".

The catalyst particles partially regenerated, as above defined, is further regenerated with an oxygen rich regeneration in a riser regeneration zone 78 extending substantially vertically upward from a lower portion of annular bed "B" and through the upper sloping wall section of regeneration zone 76 to the exterior of the regeneration zone housing catalyst beds "A" and "B". Oxygen rich gas is charged by hollow stem plug valve 80 to the bottom open end of riser 78 for admixture with partially regenerated catalyst to form an upflowing suspension "C" thereof in the riser regeneration zone. Riser 78 may be of larger diameter in a lower portion thereof as shown in the drawing before converging to a more restricted diameter portion passing through the upper sloping head of regenerator 76. More complete removal of carbonaceous deposits is accomplished in riser 78 at a temperature below 1600° F. and more usually not substantially above about 1500° F. The upper end or riser 78, external to zone 76, is connected to a horizontal section 80 and a short vertical section 82 on the outer end of the horizontal section. The short vertical section is open in the bottom end thereof for downward discharge of the regenerated catalyst particles and flue gases into a regenerated catalyst accumulation zone 84. A mass of high temperature regenerated catalyst particles 86,collected in the lower section of zone 84, is maintained in fluid like condition by the addition of a fluffing inert gas, $CO_2$, charged through the lower conical wall of zone 84. Flue gases separated from catalyst particles are passed through passageways 90 radiating outwardly from zone 84 to a cyclone separation zone 92 in the outer end of each radiating passageway. The flue gases, $CO_2$ rich, separated from entrained catalyst fines are recovered by conduits 94 as a common flue gas stream. Cyclone separated catalyst fines are passed to bed 86 by diplegs provided from each cyclone separation zone. Cyclone separation zones 92 may represent a sequence of cyclone separation zones or be a multiclone arrangement known in the art.

In another embodiment, it is contemplated modifying the upper end of riser 78 external to zone 76 to be in the shape of a half circle rather than straight sections as shown which discharges downwardly through the head of chamber 84. It is also contemplated positioning riser 78 external to vessel 76 and passing partially regenerated catalyst from a bottom portion of bed "B" by a suitable connecting conduit passageway to a bottom portion of riser 78. In yet another embodiment, it is contemplated providing two separate riser regenerators which discharge into a common vessel such as vessel 84 or into separate vessels of collected regenerated catalyst. In any of these arrangements, and particularly that of FIG. II, the regenerated catalyst collected in zone 84 as fluid bed 86 is withdrawn from the bottom thereof for passage by conduit 56 to riser hydrocarbon conversion zone 32 with a portion thereof passed as desired by conduit 96 to catalyst bed "B" for admixture with catalyst entering the bottom open end of riser 78.

The apparatus arrangement of FIG. II may be modified to include two separate riser reactors of the same or different configuration with respect to diameter and length of an expanded section thereof. The upper end of the riser restricted diameter section may be curved as desired, including a half circle section and suitable for dischargng tangentially into or downwardly into a larger separation zone. Also, the discharge end of a riser may be modified to include the apparatus arrangement disclosed with respect to FIG. I.

The combination operations of the invention may be modified to include, (1) the passage of partially regenerated catalyst alone or in combination with catalyst of the riser regeneration operation to the deasphalted oil feed riser conversion zone and, (2) the hydrogenation operation contemplated may be sufficiently severe to achieve a partial hydrocracking of the heavy oil feeds.

In yet another aspect, the horizontal portion of a riser reactor may be sloped downwardly towards the end thereof to a more downwardly directed section open in the bottom end thereof. The more downwardly directed section may be provided with a plurality of vapor flow through passageways in the upper surface thereof and which are in open communication with the inlet to one or more suitably positioned cyclone separation zones.

It is further contemplated effecting regeneration of catalyst particles in the arrangement of FIG. II with an oxygen lean regeneration gas of higher oxygen concentration in the downflowing annular catalyst bed than in the upflowing annular catalyst bed and steam may be charged with either oxygen lean regeneration gas stream.

What is claimed is:

1. In a combination process comprising fluid catalytic cracking of an oil feed in a riser cracking zone and removing hydrocarbonaceous deposits of said cracking in a catalyst regeneration zone, improved method of operation which comprises;

(a) separating a crude oil by atmospheric and vacuum distillation to obtain a middle distillate fraction boiling above kerosene, a light and a heavy vacuum gas oil, and a vacuum resid fraction, (b) effecting deep solvent deasphalting of said vacuum resid with one or a combination of butane and pentane deasphalting solvents, (c) combining an oil product of said solvent deasphalting separated from solvent with said heavy vacuum gas oil, (d) passing regenerated catalyst particules at a temperature in the range of 1400° F. to 1600° F. in a suspending lift gas comprising hydrogen into a first riser hydrocarbon conversion zone and thereafter contacted with an atomized mixture of said heavy vacuum gas oil and said deasphalted oil product under oil feed catalytic conversion conditions providing vaporous hydrocarbon conversion products with suspended catalyst particles, (e) separating hydrocarbon vaporous products from suspended catalyst particles by tangential introduction of said products and particles into a cylindrical zone positioned within a catalyst particle recovery and collection zone, said cylindrical zone open in the bottom thereof for discharge of centrifugally separated catalyst into said collection zone and removing separated vapors by an upwardly extending central passageway communicating with a sequence of product recovery cyclone separation zones, (f) passing regenerated catalyst particles suspended in gas comprising hydrogen upwardly through a second riser reactor for contact with an atomized oil feed comprising light vacuum gas oil, (g) separating a suspension of hydrocarbon vapors and catalyst upon traverse of said second riser conversion zone in a cylindrical zone open in the bottom thereof and within said catalyst recovery and collection zone, said suspension separation effected by tangential introduction into said cylindrical zone and passage of separated vapors sequentially thereafter through cyclone separation zone, (h) recovering separated vaporous hydrocarbon products of said first and second riser conversion zones and passing the hydrocarbon products to a separation zone for separation of normally gaseous products from gasoline boiling range material, light cycle oil product, heavy cycle oil product and a slurry oil product, (i) stripping catalyst separated from the hydrocarbon vapors of each riser conversion zone, and (j) regenerating the stripped catalyst in a sequence of separate catalyst regeneration zones comprising a first regeneration zone containing a dense fluid catalyst bed and a second regeneration zone consisting of a riser containing a rising fluid mass of catalyst particles said regeneration providing, a flue gas product of said first regeneration zone comprising substantial CO and a flue gas product of said second regeneration zone which is $CO_2$-rich.

2. The process of claim 1 wherein a suspension of flue gas and hot regenerated catalyst particles are discharged from said second regeneration zone tangentially into a cylindrical zone providing for recovery of separated regenerated catalyst particles in a dense fluid mass from which catalyst particles are withdrawn for passage to each of said first and second riser hydrocarbon conversion zones, centrifugally separated combustion product flue gases are passed from said cylindrical zone to a plurality of cyclone separation zones positioned about and external to said cylindrical zone and cyclone separated fines are returned to said dense fluid mass of regenerated catalyst particles.

3. The process of claim 1 wherein partially regenerated catalyst is passed from an upper portion of the dense fluid bed of catalyst to the bottom inlet thereto for admixture with spent stripped and recycled catalyst particles and an oxygen lean regeneration gas effecting restriction on the combustion temperatures encountered in said dense fluid bed regeneration operation, and passing another portion of said partially regenerated catalyst from an upper portion of the dense fluid bed directly to the inlet of said first riser hydrocarbon conversion zone charged with deasphalted oil feed.

4. The process of claim 1 wherein said hydrocarbon riser conversion zones and said catalyst regeneration zones are separately positioned horizontally adjacent to one another and sized to minimize the elevation of the combination of zones consistent with achieving a hydrocarbon conversion residence time within said first and second riser zone in the range of 0.5 to 2 seconds.

5. The method of claim 1 wherein the second regeneration zone is of a larger diameter in a lower portion thereof than in the upper portion and partially regenerated catalyst admixed with riser regenerated catalyst of little or no residual coke and an oxygen rich gas are mixed and charged to a bottom portion of said second regeneration zone.

6. The process of claim 1 wherein catalyst particles separated from vaporous hydrocarbon conversion products of the riser conversion zones are collected and stripped in a zone above a regeneration zone, said stripped catalyst is passed by a confined standpipe passageway downwardly to a bottom portion of a cylindrical zone about said standpipe and forming a first annular zone therewith, said catalyst is passed upwardly through said first annular zone with oxygen lean combustion supporting gas and overflow therefrom into a second annular zone about said first annular zone, said catalyst is contacted with oxygen lean gas during downflow in said second annular zone to complete partial regeneration of said catalyst, said partially regenerated catalyst is withdrawn from a bottom portion of said second annular zone and passed with suspending oxygen rich carbon combustion supporting gas upwardly through a riser catalyst regeneration zone to form $CO_2$ rich flue gases comprising some unconsumed oxygen and a regenerated catalyst of little or no residual coke thereon and at a temperature in the range of 1300° to 1600° F. and regenerated catalyst particles separated from $CO_2$ rich flue gases are passed to said hydrocarbon conversion riser zones.

7. The process of claim 1 wherein said first and second riser hydrocarbon conversion zones and said second regeneration zone are of a larger diameter in a bottom portion thereof than in an upper portion thereof and each discharges downwardly following partial separation of catalyst particles from gasiform material forming said suspensions into separate relatively large catalyst particle separation and recovery zones for recovery of catalyst particles from gasiform material.

8. The process of claim 6 wherein there are two separate hydrocarbon conversion riser zones and two separate riser regeneration zones positioned about said catalyst stripping zone which is positioned above said annular catalyst regeneration zones and the higher boiling oil feed components boiling above light vacuum gas oil are charged to one riser hydrocarbon conversion zone in combination with a wet or dry gas product of hydrocarbon conversion and a butane or pentane gaseous product is recovered from the hydrocarbon conversion products for use as a deasphalting solvent for a vacuum bottoms or resid product comprising high molecular weight oil components and asphaltenes.

9. The process of claim 1 wherein the heavy vacuum gas oil and the deasphalted oil product are hydrogenated under conditions sufficiently severe to effect a partial hydrocracking of the deasphalted oil fraction prior to passage to said riser hydrocarbon conversion zone.

10. The process of claim 1 wherein the deasphalted oil fraction is partially hydrocracked in a hydrogenation zone prior to admixture with heavy vacuum gas oil and passage of the mixture to the riser hydrocarbon conversion zone.

11. The process of claim 6 wherein an upper end of the riser is horizontal and the outer discharge end is sloped downwardly and is provided with a plurality vapor passageqays through the upper sloped surface thereof in open communication with the inlet to one or more cyclone separation zones positioned adjacent thereto.

12. The process of claim 11 wherein the horizontal portion of the riser is sloped downwardly to encourage formation of a higher concentration of catalyst particles from vaporous products on the bottom side thereof whereby vaporous products reduced in particle concentration are withdrawn by said plurality of vapor passageways.

13. The process of claim 6 wherein the concentration of oxygen in the oxygen lean regeneration gas is lower in the upflow catalyst annular regeneration zone than in the downflow catalyst annular regeneration zone whereby removal of hydrocarbonaceous deposits by combustion up to 75 or 80 wt. % or more is achieved without substantially exceeding an upper combustion temperature of about 1400° F. prior to completing regeneration of the catalyst in one or more riser regeneration zones restricting the temperature not to substantially exceed about 1450° F. or 1500° F.

14. The process of claim 1 wherein in step (c) said oil product of solvent deasphalting is hydrogenated before being combined with said heavy vacuum gas oil.

15. The process of claim 1 wherein in step (f) said atomized oil feed comprises light vacuum gas oil and separated middle distillate.

16. The process of claim 15 wherein said atomized oil feed further comprises a heavy cycle oil product of a catalytic cracking operation.

17. The process of claim 1 wherein in step (f) said atomized oil feed comprises light vacuum gas oil and a heavy cycle oil product of a catalytic cracking operation.

* * * * *